United States Patent [19]

Hechler

[11] Patent Number: 4,591,412

[45] Date of Patent: May 27, 1986

[54] MEANS AND METHOD FOR NEUTRAL SIZING

[75] Inventor: Erwin Hechler, Mannheim, Fed. Rep. of Germany

[73] Assignee: Giulini Chemie GmbH, Ludwigshafen/Rhein, Fed. Rep. of Germany

[21] Appl. No.: 559,961

[22] Filed: Dec. 8, 1983

[30] Foreign Application Priority Data

| | | | |
|---|---|---|---|
| Dec. 8, 1982 | [DE] | Fed. Rep. of Germany | 3245390 |
| Oct. 20, 1983 | [DE] | Fed. Rep. of Germany | 3338087 |
| Oct. 20, 1983 | [DE] | Fed. Rep. of Germany | 3338088 |

[51] Int. Cl.[4] ..... D21H 3/02

[52] U.S. Cl. ..... 162/158; 106/237; 106/238; 106/239; 162/179; 162/180; 162/181.2

[58] Field of Search ..... 162/158, 179, 180, 181.2; 106/237, 238, 239

[56] References Cited

U.S. PATENT DOCUMENTS

| | | | |
|---|---|---|---|
| 2,915,410 | 12/1959 | Schneider | 162/180 |
| 3,433,658 | 3/1969 | D'Errico et al. | 162/180 |
| 3,540,980 | 11/1970 | Jones | 162/180 |

FOREIGN PATENT DOCUMENTS

| | | | |
|---|---|---|---|
| 1036429 | 8/1958 | Fed. Rep. of Germany . | |
| 144577 | 10/1980 | German Democratic Rep. | 162/180 |
| 46-18283 | 5/1971 | Japan | 162/180 |
| 53-103003 | 9/1978 | Japan | 162/180 |
| 335902 | 10/1930 | United Kingdom | 162/180 |
| 1412254 | 10/1975 | United Kingdom | 162/180 |

OTHER PUBLICATIONS

Healy Jr. et al. "Aluminate Size", Tappi, pp. 193–195, 1933.

*Primary Examiner*—Peter Chin
*Attorney, Agent, or Firm*—Spencer & Frank

[57] ABSTRACT

A composition of matter for the neutral sizing of paper, paperboard, cardboard and other cellulose containing materials, is disclosed comprising water; a solvent which is unlimitedly miscible with water, particularly alcohol; a compound which undergoes a basic reaction; alkali aluminate; and a sizing component. When sizing is effected with this agent, the fiber containing suspension is mixed with a retention agent, before or after the addition of the sizing agent, with the sizing agent being activated by way of neutralization.

31 Claims, No Drawings

MEANS AND METHOD FOR NEUTRAL SIZING

BACKGROUND OF THE INVENTION

The present invention relates to an internal sizing agent in the neutral range for paper, paperboard, cardboard and other cellulose containing materials, as well as to a single stage method for internal sizing with such an agent.

An important additive to sizing which has been used for a long time in the paper making industry is known to be aluminum sulfate, which causes the precipitation and fixation of the sizing component, e.g. rosin, on the cellulose fiber. However, the pH that develops due to the hydrolytic splitting, depends on the aluminum sulfate concentration and is between 4.2 and about 4.8, i.e. in the distinctly acid range. This may lead to corrosion of screens and machine parts. Moreover, paper manufactured in this manner has poor aging resistance and reduced mechanical strength. A particular drawback of the acid pH is encountered when papers are to be manufactured which are streaked or mixed with calcium carbonate, e.g. due to the inclusion of waste paper, since the decomposition of calcium carbonate begins, although weakly, in the vicinity of the neutral point i.e., pH 6.5. The development of carbonic acid as well as the calcium ions going into solution may lead to considerable disturbances in the paper manufacture and may worsen the sizing of the paper.

For that reason, there has been no lack of experiments with the aim of overcoming the drawbacks and difficulties observed in connection with paper sizing when aluminum sulfate is used as the flocculation and fixing agent. However, attempts involving a raising of the pH, perhaps by reduction of the quantity of aluminum sulfate and replacement of the "saved" aluminum sulfate by a cationic retention agent, have not demonstrated the desired success. The pH of the fiber suspension could be raised in this way only to values of about 5.0 since minimum quantities of aluminum sulfate are absolutely necessary for good sizing.

U.S. Pat. No. 3,540,980 also discloses that the aluminum sulfate can be replaced entirely or in part by water soluble aluminate. In this case, aluminate solution is added to the aqueous fiber suspension to be sized until a pH of at least 9 is reached. Thereafter, the pH is lowered by means of an inorganic acid or a salt which undergoes an acid reaction, e.g. sulfuric acid or aluminum sulfate, to a pH no less than 4.5. After the addition of the resin sizing, the aluminum hydroxide produced during neutralization causes the aluminum resinate to flocculate and the resulting aluminum ions fix the resinate on the fiber. Under the stated conditions, the partial or complete substitution of aluminum sulfate by sodium aluminate leads to the desired increase in pH without a worsening of the sizing process being observed. Consequently, aluminum sulfate is no longer required to flocculate the sizing resin and to fix it to the cellulose fibers, it may be substituted by the addition of sodium aluminate and subsequent adjustment of the pH.

One drawback of the above process is now that it requires two stages and both stages must take place in highly diluted material suspensions; ancillary reactions and operational malfunctions are unavoidable if the process parameters are changed.

BRIEF DESCRIPTION OF THE INVENTION

It is the object of the present invention to provide a means and a process for neutral sizing of paper, paperboard and other cellulose containing materials wherein the above difficulties and drawbacks are eliminated.

The solution of this problem is based on the realization that the known sizing process can be improved, and particularly made more economical, if the sizing is effected with an agent which contains the aluminate as well as the sizing resin in such a manner that the precipitation of the sizing resin as aluminum resinate in the sizing agent is impossible. Such precipitation should take place only after sizing agent and cationic retention agent have been mixed into the fiber suspension.

DESCRIPTION OF THE PREFERRED EMBODIMENTS

This problem is solved by means of a sizing agent which includes water, an organic solvent that is unlimitedly miscible with water, a compound which undergoes a basic reaction, an alkali aluminate and a sizing resin. Water soluble alcohols, for example methanol, ethanol and isopropanol, can be used as organic solvents; however, water soluble ketones, e.g. acetone and others, can also be used. The weight ratio of alcohol to sizing component should lie between 10:1 and 1 and is advantageously, 5:1 to 0.5:1. The quantity of organic solvent depends on the solubility and quantity of the organic sizing component which must be completely dissolved in the sizing agent according to the invention.

Preferably, sodium hydroxide or potassium hydroxide is used as the compound which undergoes a basic reaction and is used in such quantities that the pH in the sizing agent lies at about 12, i.e. precipitation of aluminum hydroxide is avoided. If necessary, the added quantity of alkali also serves to saponify the sizing component, and such saponification is 100 when using, for example, saturated or unsaturated fatty acids having 12 to 23 carbon atoms in the sizing component.

The sizing component may be selected from rosins, modified rosins, natural resins, and modified natural resins. Fatty acids having 12 to 23 C atoms can also be used. Examples of modified rosins and natural resins are adducts of maleic acid or fumaric acid (Diels-Alder diene synthesis) or resin soaps. A preferred natural resin is tall oil resin.

The manufacture of the novel sizing agent may be effected in a very simple manner by mixing the components at room temperature in such a manner that initially solid alkali aluminate or an aqueous alkali aluminate solution is introduced into a water base. Softened or hardness stabilized water is employed. In order to avoid precipitation and possibly saponification of the sizing component, sodium hydroxide is introduced in solid or dissolved form. Finally, alcohol and sizing component are introduced under stirring. Stirring continues until the sizing component is completely dissolved. With reference to the entire effective content, the alkali content of the novel sizing agent lies between 5 and 30 weight percent, the sodium aluminate content lies between 10 and 50 weight percent and the sizing component content lies between 40 and 85 weight percent.

Softening or hardness stabilization is necessary in order to avoid precipitation and is effected according to known methods (e.g. with ethylenediamine tetraacetic acid and nitrilotriacetic acid).

The novel sizing agent can be introduced directly into the fiber suspension to be sized. After mixing in the pulper or in a connected vat, the sizing agent is activated by means of acids and/or salts which undergo an acid reaction, with the quantity of acid and/or salt being dimensioned such that a pH of about 7 is attained.

All organic and inorganic acids which form neither insoluble salts nor complex compounds with the aluminum ions can be used as activators. When neutralized to a pH of 6.8 to 7.2, the novel sizing agent produces excellent results. In addition to sulfuric acid and aluminum sulfate, formic acid and acetic acid have also been found quite acceptable in the experiments made. Cationic retention agents considerably improve the fixation of fiber and filler materials as well as the sizing agent. The quantity depends on the type of retention agent. However, 0.02 to 0.2 weight percent, with respect to the starting materials, should be sufficient.

According to another version of the process, sizing agent can be added to the aqueous suspension of cellulose fibers until a pH of a maximum of 9 is reached. Then a cation active retention agent is added, homogeneously dispersed therein, and the sizing agent is activated by setting the pH between 7.2 and 7.5. Preferably, sizing agent is added to the aqueous suspension until a pH of 7.5 to 8 or 7.6 to 8, respectively, is reached.

As in the earlier described version of the process, cationic starch derivatives, polyacrylamide, and polymethacrylamide can be added as cation active retention agents to the aqueous suspension. Quaternary nitrogen compounds can also be used and as well as active polymers. Quantities from 0.1 to 0.5 weight percent, with respect to the fiber content of the aqueous suspension, are sufficient to realize good internal sizing, while the sizing agent is used in quantities from 0.1 to 10 weight percent with respect to the fiber content of the suspension and calculated as solids content. In some cases, retention agent quantities from 0.02 weight percent, with respect to the starting material, should already be sufficient.

The activation of the sizing agent can be effected, as in the preceding process, by means of acids and/or salts which undergo an acid reaction. Organic and inorganic acids which form neither insoluble salts nor complex compounds with the aluminum ions are suitable. In addition to sulfuric acid and aluminum sulfate, formic acid and acetic acid have been found quite acceptable.

As has also been shown, the novel process can also be implemented in such a manner that initially a cation active polymeric retention agent is introduced into the aqueous suspension of cellulose fibers having a pH less than 7, particularly 6.5 to 6.8, and then the retention agent is homogeneously dispersed therein. Thereafter, sizing agent is added until a pH of more than 7 is reached. Sizing agent should be introduced into the aqueous solution until a pH of 7.5 to 8 is reached. The pH of the cellulose fiber suspension should not lie below 6.

The above-mentioned agents can be used as cation active retention agents, in quantities from 0.02 to 0.5 weight percent, with respect to the fiber content of the aqueous suspension.

The subject matter of the invention will be explained in greater detail with the aid of the following examples.

Production of the Sizing Agent

EXAMPLE 1

In a stirring vessel, 570 parts by weight softened water are provided. Into this water, 145 parts by weight sodium aluminate solution having an $Al_2O_3$ content of 19% and 25 parts by weight sodium hydroxide are stirred. As soon as the components are dissolved, 135 parts by weight isopropanol are added, then 125 parts by weight of a mixed fatty acid whose titer is 19, acid number 200, saponification number 200 and iodine number 105. Stirring continues until the solution is clear. The effective content of the neutral sizing agent is 20 weight percent.

EXAMPLE 2

As in Example 1, 645 parts by weight water are placed into a stirring vessel. After adding 50 parts by weight of a 50% sodium hydroxide solution and 45 parts by weight solid sodium aluminate in powder form, stirring continues until everything is completely dissolved. Then, 135 parts by weight isopropanol are permitted to flow in and 125 parts by weight reinforced powdered sizing resin are dispersed therein. After complete dissolution of the sizing powder, the solution is weakly yellow; 1 part by weight sorbitol is added for stabilization. The effective content of the sizing agent is about 20 weight percent.

EXAMPLE 3

A stirring vessel is filled with 630 parts by weight softened water. Then, 100 parts by weight sodium aluminate solution containing 19% $Al_2O_3$ and 25 parts by weight solid sodium hydroxide are added to the water. When the components have been dissolved and dispersed, 160 parts by weight isopropanol are added. Thereafter, a mixture of 100 parts by weight balsam resin and 10 parts by weight of a rosin that has been reacted with maleic acid are introduced into the stirring vessel. Stirring continues until all components have gone into solution.

EXAMPLE 4

In a stirring vessel containing 75 parts by weight ethanol, 50 parts by weight ground rosin and 5 parts by weight rosin that has been reacted with maleic acid are stirred until the solid components are completely dissolved. Then, 50 parts by weight sodium aluminate solution containing 19 weight percent $Al_2O_3$ are introduced while stirring as well as 25 parts by weight of a 50% sodium hydroxide solution. Finally, 101 parts by weight softened water are added. A reddish brown solution is obtained which has a solids content of 27.4%.

EXAMPLE 5

365 parts by weight city water, having a hardness of 25° (German), are pumped into a stirring vessel and mixed with 1 part by weight ethylenediamine tetraacetic acid or nitrilotriacetic acid, respectively. Under stirring, 200 parts by weight of a sodium aluminate solution containing 19 weight percent $Al_2O_3$ are then added, as well as 35 parts by weight sodium hydroxide in flake form and 200 parts by weight ethanol. Stirring continues until a clear solution has formed. Then, 160 parts by weight ground rosin and 40 parts by weight ground rosin that has been reacted with maleic acid are added and stirred until all solids are dissolved. The end product is a clear, reddish brown solution having a solids content of 30%.

EXAMPLE 6

In a stirring vessel, 365 parts by weight of hardness stabilized tap water are mixed with 200 parts by weight sodium aluminate solution (containing 19% $Al_2O_3$). Then, 35 parts by weight sodium hydroxide in flake form are added. An alcohol mixture comprising 160 parts by weight ethanol and 40 parts by weight methanol is introduced into the solution and stirred until the solution is clear. Then 200 parts by weight ground rosin having a degree of maleination of about 10% are added. The end product is a transparent, reddish brown liquid having a solids content of 30%.

Internal Sizing

EXAMPLE 7

The fiber starting material for the sizing process in this Example includes 85 weight percent cellulose (50% spruce sulfite cellulose, 50% bleached pine sulfate cellulose), 10 weight percent chalk (filler) and 5 weight percent water soluble starch. The freeness value of the mixture is about 30° SR. Sizing is effected with a 3% fiber substance starting material. This starting material is mixed with enough sizing agent of Example 1 that the effective sizing agent quantity in the starting material is 2.5 weight percent with respect to the fiber material. After mixing, the suspension is pumped into the mixing vat and is brought to a pH of 6.8 with diluted sulfuric acid (50%). Then a cationic retention agent is added in the usual manner.

After sheet formation and drying, a fully sized paper is obtained which has an ink float duration of more than 8 minutes and a $Cobb^{(60)}$ value of less than 30. The basis weight range of the sized paper lies between 110 and 120 g/m$^2$.

EXAMPLE 8

A wood containing starting material is processed into a semisized printing paper. For this purpose, the cellulose is initially processed in a pulper, then beaten and fed into a mixing vat. In the mixing vat, the 3.5% starting material suspension is mixed, under continuous stirring, with a sizing agent according to Example 2, i.e. 5 parts by weight of the 20% sizing agent are added to every 100 parts by weight of starting material. After thorough mixing, the suspension is pumped into an intermediate vat and is activated by means of a 10% nitric acid solution. The activation is completed at a pH of 6.8. In order to improve the fixation of the fiber and filler material and the sizing agent, a cationic retention agent is then added as in Example 7.

The sized mass is processed into paper which has an ash content of 15 weight percent (kaolin content) and a basis weight of 70 g/cm$^2$. Its $Cobb^{(60)}$ value is 45.

EXAMPLE 9

A paper recycling plant, which operates with tightly closed water circulation, manufactures packing paper. Dirt inclusion and hardness are therefore high (hardness greater than 100° (German).

A sizing agent according to Example 2 is introduced into a mixing vat and is well mixed with the waste paper starting material. For every 100 g waste paper, 2.25 weight percent effective sizing agent are used. The activation is effected with diluted sulfuric acid (50%) or aluminum sulfate, respectively, in an intermediate vat. The pH during the activation is 6.7 or 6.8, respectively, and the material density is 3.0%. A cationic retention agent is also added. The fully sized packing paper has a basis weight of 110 or 120 g/m$^2$, respectively.

EXAMPLE 10

In a mixing vat having a capacity of 25 m$^3$, a suspension of solids having a density of 4% is introduced. The material is dissolved fiber material, including 55% mixed paper waste, 25% corrugated cardboard waste and 20% paperboard waste. The pH of the suspension lies at 6.9. This suspension is now mixed with 125 kg of the 20% neutral sizing agent according to Example 3. This causes the pH to rise to 8.35. Once the sizing agent has been well mixed with the fiber material suspension, 1.5 kg polyethyleneimine are measured in and uniformly dispersed in the mass of material. The pH of the suspension does not change because of this addition. The activator (diluted sulfuric acid) then poured slowly into the vat until the pH reaches a value around 7.3. The further processing in the machine takes place in the usual manner and the end product is a cardboard having a Cobb value (60 seconds) between 50 and 75.

EXAMPLE 11

Neutral mass sizing is effected with a starting substance including 50 bleached spruce sulfite cellulose and 50% bleached ground pulp. The starting mixture, which is disposed in a mixing vat, has a density of 4% and a pH of 6.5, is mixed with a highly cationic retention agent (a polyethyleneimine, i.e., the commercially available product Poly(min SK), in quantities of 0.2 weight percent with respect to the fiber content. After thorough mixing, 2% sizing agent (100%) produced according to Example 3, are added. Thereafter, the mass is pumped around in the machine vat and is simultaneously diluted with approximately five times the quantity of water (with respect to its volume) and brought to the required initial processing consistency of about 0.8%. After dewatering and drying of the paper sheet, the end product is an excellently sized paper.

EXAMPLE 12

Internal sizing is performed as in Example 7, but without the addition of starch. The sizing agent according to Example 4 furnishes a fully sized paper having a $Cobb^{(60)}$ value of less than 30 with a basis weight for the paper of 70 g/m$^2$.

I claim:

1. A sizing agent composition of matter for the neutral sizing of paper, paperboard, cardboard and other cellulose containing materials, comprising water, an organic solvent that is unlimitedly miscible with water, a water soluble alkali compound, an alkali aluminate and a sizing component; wherein the alkali compound is present in a sufficient amount to maintain a pH of about 12 in the composition and to completely saponify any fatty acids present, and the alkali aluminate and sizing component are present in amounts of at least 10% by weight and 40% by weight, respectively, based on the total weight of alkali compound, alkali aluminate and sizing component in said composition, and wherein the organic solvent is selected such that the sizing component is completely dissolved and the sizing component is one or more compounds selected from the group consisting of rosins, modified rosins, natural resins, modified natural resins and fatty acids having 12 to 23 carbon atoms, said sizing agent composition being a clear solution.

2. The composition of matter according to claim 1, wherein alcohol is the organic solvent.

3. The composition of matter according to claim 2, wherein the weight ratio of alcohol to sizing component is 0.5:1 to 5:1.

4. The composition of matter according to claim 1, wherein the alkali compound is one or more compounds selected from the group consisting of sodium hydroxide, potassium hydroxide and ammonium hydroxide.

5. The composition of matter according to claim 1, wherein the sizing component is a saturated or unsaturated fatty acid having 12 to 24 carbon atoms.

6. The composition of matter according to claim 5, wherein the sizing component is a completely saponified fatty acid.

7. The composition of matter according to claim 1, wherein the sizing component is rosin.

8. The composition of matter according to claim 1, wherein the sizing component is a tall oil resin.

9. The composition of matter according to claim 1, wherein the sizing component is a rosin that has been reacted with maleic acid or fumaric acid.

10. The composition of matter according to claim 1, wherein the sizing component is a tall oil resin that has been reacted with fumaric or maleic acid.

11. The composition of matter according to claim 1, comprising 5 to 30 weight percent alkali compound, 10 to 50 weight percent aluminate and 40 to 85 weight percent sizing component.

12. The composition of matter according to claim 1, comprising, as a stabilizing agent, sorbitol in an amount of 0.25 weight percent with respect to the total solid content of the composition.

13. A method for the neutral sizing of paper, paperboard, carboard and other cellulose containing materials using the clear solution sizing agent composition of claim 1, comprising adding said sizing agent composition to a cellulose fiber suspension in quantities of from about 0.1 to about 10 weight percent, with respect to the fiber content of the suspension and calculated as solids contents, and activating said sizing agent composition by adding a cationic retention agent.

14. The method according to claim 13, wherein the sizing agent is first introduced into the fiber suspension and homogeneously dispersed therein, and is thereafter activated by introducing a cationic retention agent.

15. The method according to claim 14, wherein the cationic retention agent is a polymeric retention agent.

16. The method according to claim 13, wherein activation is effected by way of neutralization with inorganic or organic acids to a pH of about 7, particularly 6.8 to 7.2.

17. The method according to claim 13, wherein activation is effected by way of neutralization with salts which undergo an acid reaction.

18. The method according to claim 16, wherein activation is effected with sulfuric acid or formic acid.

19. The method according to claim 17, wherein activation is effected with aluminum sulfate.

20. The method according to claim 13, wherein the sizing agent is introduced into an aqueous suspension of cellulose fibers until a pH of a maximum of 9 is reached, then a cation active polymeric retention agent is introduced, is homogeneously dispersed therein and the sizing agent is activated by setting the pH to about 7, particularly to 7.2 to 7.5.

21. The method according to claim 20, wherein the sizing agent is introduced into the aqueous suspension until a pH of 7.6 to 8 is reached.

22. The method according to claim 20, wherein activation is effected by way of neutralization with inorganic or organic acids.

23. The method according to claim 20, wherein activation is effected by way of neutralization with salts which undergo an acid reaction.

24. The method according to claim 23, wherein activation is effected with aluminum sulfate.

25. The method according to claim 22, wherein activation is effected with sulfuric acid or formic acid.

26. The method according to claim 13, wherein the cationic retention agent is one or more compound selected from the group consisting of polyethyleneimine, cationic starch, polyacrylamide, polymethacrylamide and a quaternary nitrogen compound.

27. The method according to claim 13, wherein the cationic retention agent is introduced in quantities of from about 0.1 to about 0.5 weight percent, with respect to the fiber content of the aqueous suspension.

28. The method according to claim 15, wherein a cationic polymeric retention agent is initially introduced into an aqueous suspension of cellulose fibers having a pH of 6.5 to 6.9 and is homogeneously dispersed therein, whereupon sizing agent is added until a pH of greater than 7 is reached.

29. The method according to claim 28, wherein the sizing agent is added to the aqueous suspension until a pH of 7 to 8 is reached.

30. The method according to claim 28, wherein the cationic retention agent is one or more compound selected from the group consisting of polyethyleneimine, cation active starch, polyacrylamide, polymethracylamide and a quaternary nitrogen.

31. The method according to claim 28, wherein the active retention agent is added in quantities of from about 0.02 to about 0.5 weight percent, with respect to the fiber content of the aqueous suspension.

* * * * *